US008712262B2

(12) United States Patent
Nishida et al.

(10) Patent No.: US 8,712,262 B2
(45) Date of Patent: Apr. 29, 2014

(54) IMAGE FORMING APPARATUS WITH STATIC ELIMINATION

(75) Inventors: Akinori Nishida, Kyoto (JP); Takahiro Sasai, Kyoto (JP); Shu Ikezaki, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 230 days.

(21) Appl. No.: 13/259,309

(22) PCT Filed: Apr. 15, 2010

(86) PCT No.: PCT/JP2010/002729
§ 371 (c)(1),
(2), (4) Date: Sep. 23, 2011

(87) PCT Pub. No.: WO2010/122745
PCT Pub. Date: Oct. 28, 2010

(65) Prior Publication Data

US 2012/0014705 A1 Jan. 19, 2012

(30) Foreign Application Priority Data

Apr. 23, 2009 (JP) ..... 2009-105719

(51) Int. Cl.
*G03G 15/16* (2006.01)

(52) U.S. Cl.
USPC ..... 399/44

(58) Field of Classification Search
USPC ..... 399/44, 66, 297, 310, 314
See application file for complete search history.

(56) References Cited

U.S. PATENT DOCUMENTS

| | | | |
|---|---|---|---|
| 5,799,226 | A | 8/1998 | Shigeta et al. |
| 2007/0286647 | A1 | 12/2007 | Sano et al. |

FOREIGN PATENT DOCUMENTS

| | | | |
|---|---|---|---|
| JP | 10-340010 | A | 12/1998 |
| JP | 2002-365923 | A | 12/2002 |
| JP | 2003-280410 | A | 10/2003 |
| JP | 2006-010882 | A | 1/2006 |
| JP | 2006-259235 | A | 9/2006 |
| JP | 2007-171425 | A | 7/2007 |
| JP | 2007-333829 | A | 12/2007 |
| JP | 2008-185664 | A | 8/2008 |
| JP | 2008-241862 | A | 10/2008 |

OTHER PUBLICATIONS

Official Communication issued in International Patent Application No. PCT/JP2010/002729, mailed on May 25, 2010.
English translation of Official Communication issued in corresponding International Application PCT/JP2010/002729, issued on Nov. 22, 2011.

*Primary Examiner* — Quana M Grainger
(74) *Attorney, Agent, or Firm* — Keating & Bennett, LLP

(57) ABSTRACT

An image forming apparatus that prevents transfer defects such as the occurrence of white spots includes a photoreceptor drum, a transfer roller, a transfer bias application circuit that applies a transfer bias to the transfer roller, a static elimination needle that eliminates static of a recording paper, a static elimination bias application circuit that applies a static elimination bias to the static elimination needle, and a printer controller. The printer controller controls the static elimination bias application circuit so that a potential difference between the static elimination needle and the recording paper during the period from when a front end region of the recording paper passes by the static elimination needle until when a front end of the recording paper comes into contact with a conveyance guide becomes smaller than the potential difference during the period that the front end region of the recording paper passes by the static elimination needle.

9 Claims, 12 Drawing Sheets

IMAGE FORMING APPARATUS WITH STATIC ELIMINATION

BACKGROUND OF THE INVENTION

1. Field of the Invention

The present invention relates to an image forming apparatus including an electrophotographic system.

2. Description of the Related Art

In recent years, an electrophotographic image forming apparatus which forms an image by forming an electrostatic latent image as a result of charging and exposing a surface of a photoreceptor drum, affixing the charged toner to the electrostatic latent image so as to form a toner image, and transferring the toner image to recording paper is being broadly used. With this kind of image forming apparatus, upon transferring the toner image to the recording paper, the recorded paper that is sandwiched between the photoreceptor drum and a transfer roller is charged by the transfer roller. The toner is thereby transferred to the recording paper by electrostatic force. Moreover, since it becomes easy for the recording paper to stick in the photoreceptor drum by the electrostatic force, the image forming apparatus described in following Japanese Patent Application Laid-open No. 2002-365923 adopts a configuration of eliminating static from the recording paper with a static elimination needle to which a static elimination bias was applied.

Meanwhile, when the recording paper passes through a transfer nip portion between the photoreceptor drum and the transfer roller and the portion of the recording paper that passed through the transfer nip portion is separated from the photoreceptor drum, the posture of the portion of the recording paper becomes unstable. The portion of the recording paper where the posture is unstable tends to be drawn toward the static elimination needle to which a static elimination bias was applied. When a portion of the recording paper comes too close to the static elimination needle, a closed circuit connecting the transfer roller, the recording paper and the static elimination needle is formed, and the electric charge that was supplied to the recording paper via the transfer roller will escape through the static elimination needle. In the foregoing case, since the recording paper will not be sufficiently charged, toner will not be sufficiently affixed to the surface of the recording paper, and there is a possibility that transfer defects such as white spots will occur.

SUMMARY OF THE INVENTION

In order to resolve the foregoing problems, preferred embodiments of the present invention provide an image forming apparatus that prevents transfer defects such as white spots.

An image forming apparatus according to a preferred embodiment of the present invention is an image forming apparatus for electrophotographically forming an image on recording paper including a photoreceptor drum including an outer circumferential surface on which a toner image is formed, a transfer member which is provided in contact with the photoreceptor drum and transfers the toner image formed on the outer circumferential surface of the photoreceptor drum to the recording paper, a transfer bias application circuit that applies a transfer bias to the transfer member, a static elimination member which is disposed on a side that is more downstream in a conveyance direction of the recording paper than the transfer member and which eliminates static from the recording paper to which the toner image has been transferred, a static elimination bias application circuit that applies a static elimination bias to the static elimination member, a conveyance guide which is disposed on a side that is more downstream than the static elimination member and which guides the conveyance of the recording paper that has passed by the static elimination member, and a controller that is arranged and programmed to control the static elimination bias application circuit so that a potential difference between the static elimination member and the recording paper during the period from when a front end region of the recording paper passes by the static elimination member until when a front end of the recording paper comes into contact with the conveyance guide becomes smaller than the potential difference during the period that the front end region of the recording paper passes by the static elimination member.

According to the image forming apparatus of a preferred embodiment of the present invention, after the toner image is formed on the photoreceptor drum, an electric charge is supplied to the recording paper via the transfer member as a result of a transfer bias being applied to the transfer member when the recording paper passes through the transfer nip portion between the transfer member and the photoreceptor drum. Consequently, the recording paper is charged and the toner image formed on the photoreceptor drum is transferred to the recording paper. Moreover, as a result of a static elimination bias being applied to the static elimination member by the static elimination bias application circuit while the front end region of the recording paper passes by the static elimination member, the static of the front end region of the recording paper is eliminated and the front end region of the recording paper can be easily separated from the photoreceptor drum.

The posture of the portion of the recording paper that passed through the transfer nip portion will become unstable during the period after the front end region of the recording paper is separated from the photoreceptor drum and until the front end of the recording paper comes into contact with the conveyance guide. With the image forming apparatus according to a preferred embodiment of the present invention, the static elimination bias application circuit is controlled so that a potential difference between the static elimination member and the recording paper during the period from when the front end region of the recording paper passes by the static elimination member until when the front end of the recording paper comes into contact with the conveyance guide becomes smaller than the potential difference during the period that the front end region of the recording paper passes by the static elimination member. It is thereby possible to prevent the portion of the recording paper where the posture is unstable from being drawn toward the static elimination member, and prevent a closed circuit connecting the transfer member, the recording paper and the static elimination member from being formed. In other words, it is possible to prevent the electric charge that was supplied to the recording paper via the transfer member from flowing to the static elimination member. Accordingly, it is possible to prevent the effective charge amount to transfer the toner to the recording paper from decreasing, and prevent transfer defects such as white spots.

With the image forming apparatus according to a preferred embodiment of the present invention, preferably, the static elimination bias is a bias of reverse polarity relative to the transfer bias, and the controller controls the static elimination bias application circuit so that an absolute value of the static elimination bias that is applied during the period from when the front end region of the recording paper passes by the static elimination member until when the front end of the recording paper comes into contact with the conveyance guide becomes smaller than an absolute value of the static elimination bias that is applied during the period that the front end region of the recording paper passes by the static elimination member.

According to the foregoing configuration, the potential difference between the static elimination member and the recording paper during the period from when the front end region of the recording paper passes by the static elimination member until when the front end of the recording paper comes into contact with the conveyance guide can be made to be smaller than the potential difference while the front end region of the recording paper passes by the static elimination member. Thus, as described above, it is possible to prevent the portion of the recording paper where the posture is unstable from being drawn toward the static elimination member, and prevent the closed circuit from being formed. Accordingly, it is possible to prevent the effective charge amount to transfer the toner to the recording paper from decreasing, and prevent transfer defects such as white spots.

With the image forming apparatus according to a preferred embodiment of the present invention, preferably, the controller controls the static elimination bias application circuit so that the static elimination bias of reverse polarity relative to the transfer bias is applied to the static elimination member during the period that the front end region of the recording paper passes by the static elimination member, and so that a value of the static elimination bias that is applied to the static elimination member becomes 0 during the period from when the front end region of the recording paper passes by the static elimination member until when the front end of the recording paper comes into contact with the conveyance guide.

According to the foregoing configuration, the potential difference between the static elimination member and the recording paper during the period from when the front end region of the recording paper passes by the static elimination member until when the front end of the recording paper comes into contact with the conveyance guide can be made to be smaller than the potential difference while the front end region of the recording paper passes by the static elimination member. Thus, as described above, it is possible to prevent the portion of the recording paper where the posture is unstable from being drawn toward the static elimination member, and prevent the closed circuit from being formed. Accordingly, it is possible to prevent the effective charge amount to transfer the toner to the recording paper from decreasing, and prevent transfer defects such as white spots.

With the image forming apparatus according to a preferred embodiment of the present invention, preferably, the controller controls the static elimination bias application circuit so that the static elimination bias of reverse polarity relative to the transfer bias is applied to the static elimination member during the period that the front end region of the recording paper passes by the static elimination member, and so that the static elimination bias of the same polarity as the transfer bias is applied to the static elimination member during the period from when the front end region of the recording paper passes by the static elimination member until when the front end of the recording paper comes into contact with the conveyance guide.

In the foregoing case, the potential difference between the static elimination member and the recording paper during the period from when the front end region of the recording paper passes by the static elimination member until when the front end of the recording paper coming in contact with the conveyance guide can be made to be smaller than the potential difference while the front end region of the recording paper passes by the static elimination member. Thus, as described above, it is possible to prevent the portion of the recording paper where the posture is unstable from being drawn toward the static elimination member, and prevent the closed circuit from being formed. Accordingly, it is possible to prevent the effective charge amount to transfer the toner to the recording paper from decreasing, and prevent transfer defects such as white spots.

With the image forming apparatus according to a preferred embodiment of the present invention, preferably, the image forming apparatus further includes a detector that is arranged to detect environmental conditions including at least one of either temperature or humidity, and the controller controls the static elimination bias application circuit so that the static elimination bias which is set based on the environmental conditions detected by the detector is applied to the static elimination member after the front end of the recording paper comes into contact with the conveyance guide.

When the front end of the recording paper reaches the conveyance guide, since the portion of the recording paper that passed through the transfer nip portion is supported by a guide, the posture of the recording paper will be stable. In this preferred embodiment of the present invention, since the static elimination bias set based on the environmental conditions is applied to the static elimination member in the foregoing state, the static of the recording paper can be eliminated according to the temperature or humidity so that the recording paper can be easily separated from the photoreceptor drum.

With the image forming apparatus according to a preferred embodiment of the present invention, preferably, the controller controls the static elimination bias application circuit so that the static elimination bias which is set based on a value of current flowing in the transfer member when a test voltage is applied to the transfer member is applied to the static elimination member after the front end of the recording paper comes into contact with the conveyance guide.

When the front end of the recording paper reaches the conveyance guide, since the portion of the recording paper that passed through the transfer nip portion is supported by a guide, the posture of the recording paper will be stable. In this preferred embodiment of the present invention, the static elimination bias that was set based on the value of current flowing in the transfer member when a test voltage is applied to the transfer member is applied to the static elimination member. If a transfer member in which the resistance value will change due to the temperature and humidity is used, the static elimination bias can be set according to the temperature and humidity by setting the static elimination bias based on the foregoing current value. Accordingly, the static of the recording paper can be eliminated according to the temperature or humidity so that the recording paper can be easily separated from the photoreceptor drum.

An image forming apparatus according to a preferred embodiment of the present invention preferably is an image forming apparatus for electrophotographically forming an image on recording paper including a photoreceptor drum that includes an outer circumferential surface on which a toner image is formed, a transfer member which is provided in contact with the photoreceptor drum and transfers the toner image formed on the outer circumferential surface of the photoreceptor drum to the recording paper, a transfer bias application circuit that applies a transfer bias to the transfer member, a static elimination member which is disposed on a side that is more downstream in a conveyance direction of the recording paper than the transfer member and which eliminates static of the recording paper to which the toner image has been transferred, a static elimination bias application circuit that applies a static elimination bias to the static elimination member, a conveyance guide which is disposed on a side that is more downstream than the static elimination member and which guides the conveyance of the recording paper that has passed by the static elimination member, and a controller arranged and programmed to control the transfer bias application circuit so that an absolute value of the transfer bias that is applied during the period from when a front end region of the recording paper passes by the static elimination member until when a front end of the recording paper comes into contact with the conveyance guide becomes greater than an absolute value of the transfer bias that is applied after the front end of the recording paper comes into contact with the conveyance guide.

According to the image forming apparatus of a preferred embodiment of the present invention, the charge amount that is supplied to the recording paper from the transfer member during the period from when the front end region of the recording paper passes by the static elimination member until when the front end of the recording paper comes into contact with the conveyance guide can be made to be greater than the charge amount that is supplied after the front end of the recording paper comes into contact with the conveyance guide. Thus, even if the portion of the recording paper in which the posture is of an unstable state is drawn toward the static elimination member and the closed circuit is formed, since the electric charge is replenished in the recording paper, it is possible to prevent the effective charge amount to transfer the toner to the recording paper from decreasing. Accordingly, it is possible to prevent transfer defects such as white spots.

An image forming apparatus according to a preferred embodiment of the present invention preferably is an image forming apparatus for electrophotographically forming an image on recording paper including a photoreceptor drum that includes an outer circumferential surface on which a toner image is formed, a transfer member which is provided in contact with the photoreceptor drum and transfers the toner image formed on the outer circumferential surface of the photoreceptor drum to the recording paper, a transfer bias application circuit that applies a transfer bias to the transfer member, a static elimination member which is disposed on a side that is more downstream in a conveyance direction of the recording paper than the transfer member and which eliminates static of the recording paper to which the toner image has been transferred, a static elimination bias application circuit that applies a static elimination bias to the static elimination member, a conveyance guide which is disposed on a side that is more downstream than the static elimination member and which guides the conveyance of the recording paper that has passed by the static elimination member, and a controller that is arranged and programmed to control the transfer bias application member based on constant voltage control during the period from when a front end region of the recording paper passes by the static elimination member until when a front end of the recording paper comes into contact with the conveyance guide, and to control the transfer bias application circuit based on constant current control after the front end of the recording paper comes into contact with the conveyance guide.

According to the image forming apparatus of a preferred embodiment of the present invention, when the portion of the recording paper in which the posture is of an unstable state is drawn toward the static elimination member and the closed circuit is formed, the electric charge from the recording paper flows to the static elimination member. However, since the transfer bias application circuit is controlled to achieve a constant voltage, it is possible to replenish the electric charge in the recording paper for the amount that flowed to the static elimination member. It is thereby possible to prevent the effective charge amount to transfer the toner to the recording paper from decreasing. Accordingly, it is possible to prevent transfer defects such as white spots.

With the image forming apparatus according to a preferred embodiment of the present invention, preferably, the image forming apparatus further includes a detector arranged to detect environmental conditions including at least one of either temperature or humidity, and the controller controls the transfer bias application circuit so that the transfer bias which is set based on the environmental conditions detected by the detector is applied to the transfer member after the front end of the recording paper comes into contact with the conveyance guide.

In the foregoing case, since a transfer bias can be set based on the environmental conditions that will affect the transfer, the transfer can be performed favorably, and the image quality can be improved.

With the image forming apparatus of a preferred embodiment of the present invention, preferably, the controller controls the transfer bias application circuit so that the transfer bias which is set based on a value of current flowing in the transfer member when a test voltage is applied to the transfer member after the front end of the recording paper comes into contact with the conveyance guide.

If a transfer member in which the resistance value changes due to the temperature and humidity is used, the transfer bias can be set according to the temperature and the humidity by setting the transfer bias based on the foregoing current value. Accordingly, since the transfer bias is set based on the environmental conditions that will affect the transfer, the transfer can be performed favorably, and the image quality can be improved.

According to various preferred embodiments of the present invention, it is possible to provide an image forming apparatus that prevents transfer defects such as the occurrence of white spots.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
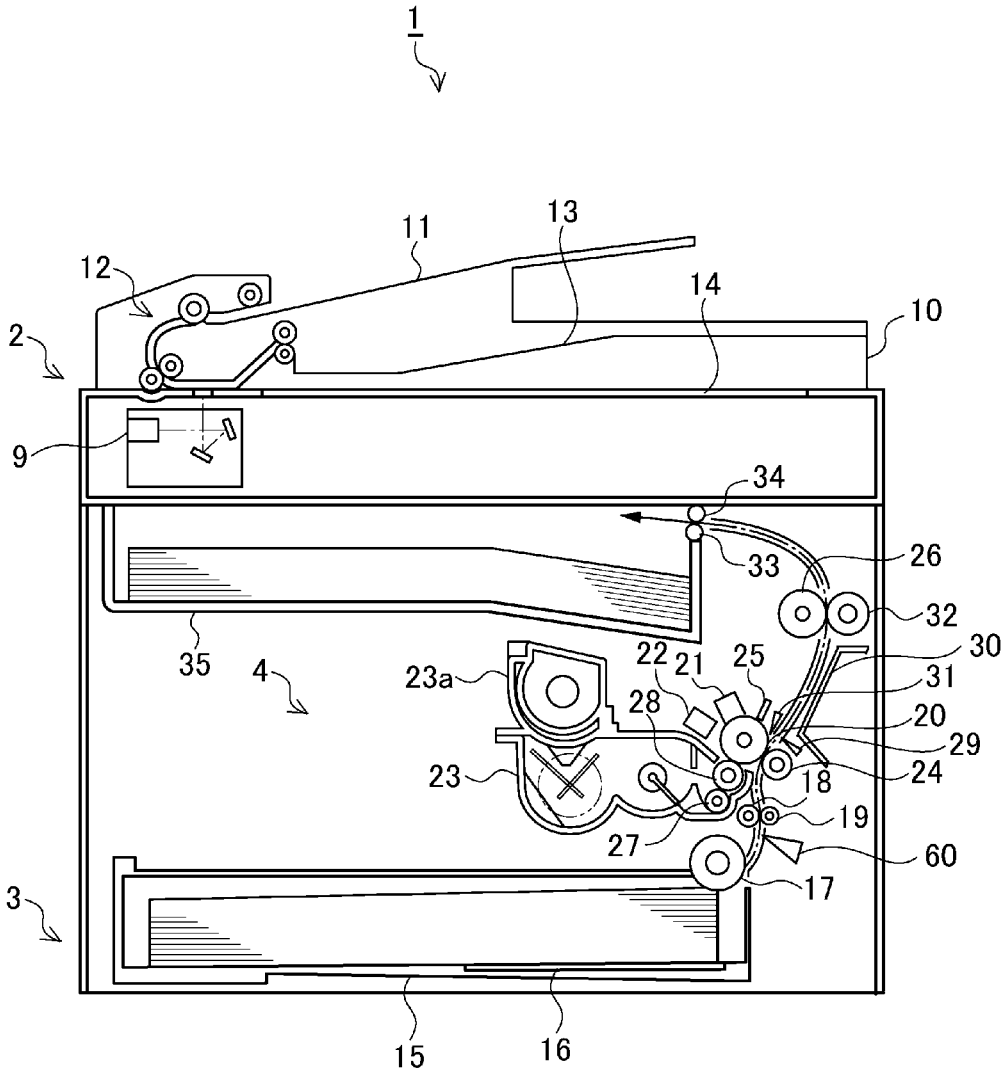
FIG. 1 is a schematic diagram showing the overall configuration of the image forming apparatus according to a first preferred embodiment of the present invention.

Preferred embodiments of the present invention will now explained in detail with reference to the appended drawings. Note that, in the respective diagrams, the same reference numeral is given to the same element and any redundant explanation is omitted.

First Preferred Embodiment

Figure 2:
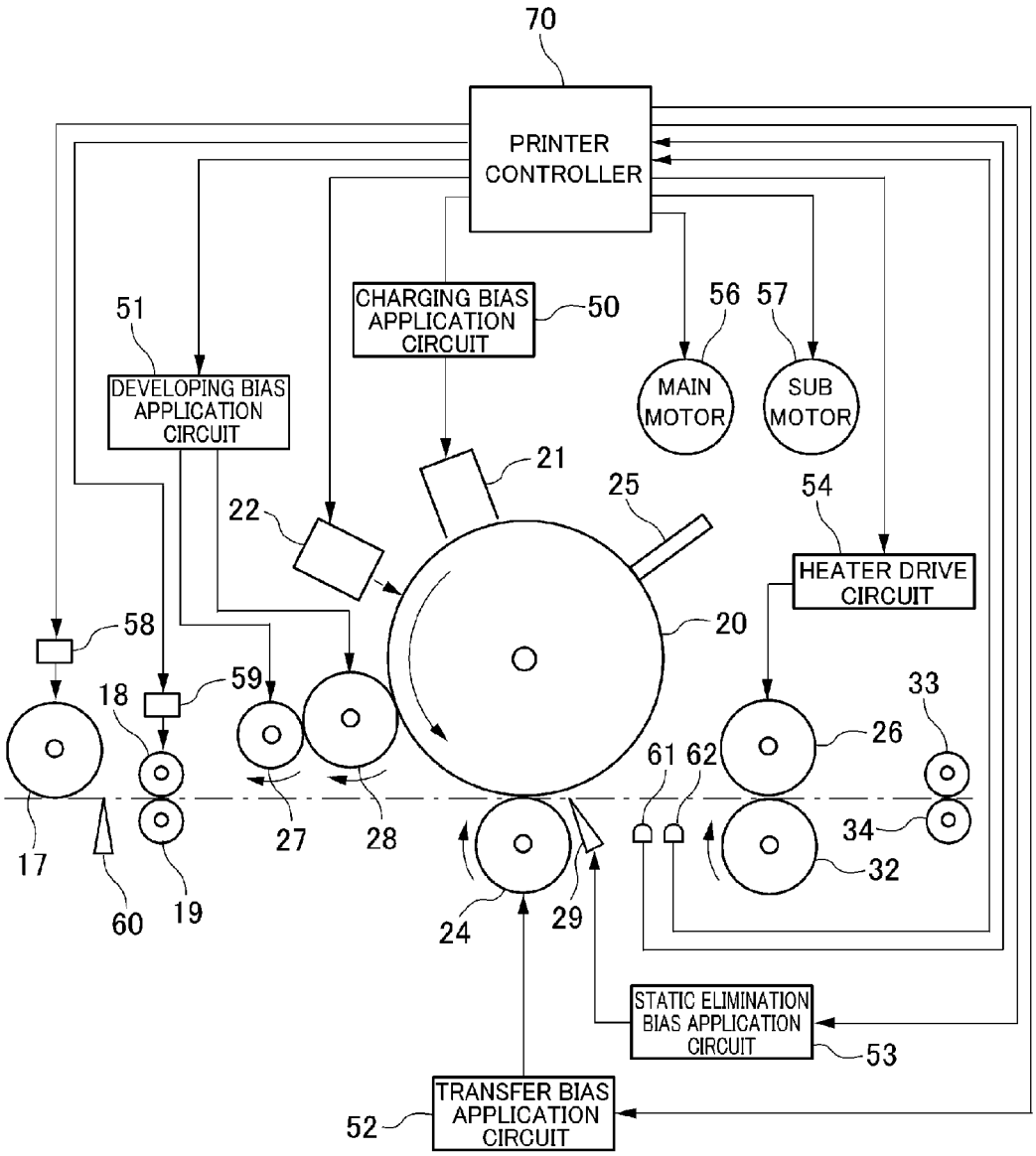
FIG. 2 is a block diagram showing the circuit configuration of the image forming apparatus according to the first preferred embodiment of the present invention.

The configuration of the image forming apparatus 1 according to the first preferred embodiment will be explained with reference to both FIG. 1 and FIG. 2. FIG. 1 is a schematic diagram showing the overall configuration of the image forming apparatus 1. FIG. 2 is a block diagram showing the circuit configuration of the image forming apparatus 1. The image forming apparatus 1 preferably is an electrophotographic image forming apparatus, and uses a contact-type mono-component nonmagnetic development system. This image forming apparatus 1 is used, for example, as a printer.

A document scanner 2 is disposed at the upper portion of the image forming apparatus 1, and a paper feeding portion 3 and a recording portion 4 are disposed at the lower portion thereof. In the document scanner 2, when a document is set on a document tray 11 provided to a document cover 10, the document is fed by a auto document feeder 12 to a position that is opposite to a scanning device 9 and scanned, and thereafter ejected to a document receiving tray 13. When reading a book or the like, the document cover 10 is rotated upward and the portion of a book or the like to be scanned is placed on a platen 14, and the scanning operation by the scanning device 9 is thereby performed. Note that the image information of the scanned document is sent to a printer controller 70 described later.

A paper feeding cassette 15 is provided to the paper feeding portion 3, and a plurality of sheets of recording paper of a predetermined size are mounted on a flapper 16 disposed at the lower portion of the paper feeding cassette 15. A pickup roller 17 is disposed at the end of the paper feeding cassette 15. The flapper 16 is biased upward by a spring member so that the upper surface of the mounted recording paper is pressed against the pickup roller 17. Thus, when the pickup roller 17 is rotatably driven, the recording paper is fed to the recording paper conveyance path one sheet at a time based on the friction action of a friction pad (not shown) mounted on the surface of the pickup roller 17, and the recording paper. Note that, in FIG. 1, the recording paper conveyance path is shown with a dashed line.

The recording paper that was fed from the paper feeding cassette 15 is detected by a PSS sensor 60 disposed on the paper feeding path to detect that the recording paper has been conveyed to a predetermined position. The recording paper is thereafter conveyed to the recording portion 4 by a pair of resist rollers 18, 19. The recording portion 4 preferably includes a photoreceptor drum 20, a charger 21, an exposure head 22, a developing unit 23, a transfer roller 24, a cleaning blade 25, and fixing roller 26 in order to record the image information on the conveyed recording paper.

The photoreceptor drum 20 is of a cylindrical shape, provided with a photoconductive film of a prescribed film thickness as a photoreceptor on its outer circumferential surface, and is rotatably driven by a main motor 56. The charger 21, the exposure head 22, the developing unit 23, the transfer roller 24, and the cleaning blade 25 are arranged in that order around the photoreceptor drum 20 along its rotating direction, and an electrostatic latent image is formed on the surface thereof by the charger 21, the exposure head 22, and the developing unit 23.

The charger 21 preferably is a so-called scorotron charger (corona charger) in which a corona wire made from a fine wire of tungsten or the like is surrounded by a casing, and uniformly charges the surface of the photoreceptor drum 20. A charging bias application circuit 50 is connected to the charger 21, and negative charging bias is applied thereto. As a result of the charging bias application circuit 50 applying a charging bias to the charger 21 based on a control signal from the printer controller 70, the surface of the photoreceptor drum 20 becomes a uniformly charged to approximately −750 V, for example.

The exposure head (exposure unit) 22 irradiates LED light output from an LED head onto the surface of the photoreceptor drum 20 to expose the surface of the photoreceptor drum 20, and thereby forms an electrostatic latent image. More specifically, the exposure head 22 irradiates LED light onto the surface of the photoreceptor drum 20 that was charged uniformly based on the image information that was input from the printer controller 70, and exposes the surface of the photoreceptor drum to form an electrostatic latent image corresponding to the image information. Moreover, the surface of the photoreceptor drum 20 is eliminated by being exposed, and the surface potential after the exposure becomes approximately −100 V, for example.

The developing unit 23 is provided to the downstream side of the exposure head 22 along the rotating direction of the photoreceptor drum 20. A detachable toner cartridge **23*a* is provided at the upper portion of the developing unit 23, and non-magnetic mono-component toner within the toner cartridge 23*a* is supplied into the developing unit 23. The developing unit 23 transfers the toner onto the electrostatic latent image of the photoreceptor drum 20 by the supply roller 27 and the development roller 28** in order to form a toner image.

As shown in FIG. 2, a developing bias application circuit 51 is connected to the supply roller 27 and the development roller 28 in the developing unit 23. The developing bias application circuit 51 applies a bias voltage to the supply roller 27 and the development roller 28, respectively, based on a control signal output from the printer controller 70. A predetermined supplying bias (for example, about −350 V) is applied to the supply roller 27, and the supply roller 27 supplies the toner in the developing unit 23 to the development roller 28 while charging the toner negatively. A predetermined developing bias (for example, about −300 V) is applied to the development roller 28, and the development roller 28 transfers the toner by coming in contact with the surface of the photoreceptor drum 20 and using the potential difference with the exposed portion.

The transfer roller 24 is arranged to come into contact with the outer circumferential surface of the photoreceptor drum 20 on the downstream side of the development unit 23 along the rotating direction of the photoreceptor drum 20, and defines a transfer nip. As the transfer roller 24, an electronic conductive roller or an ion conductive roller is preferably used. A transfer bias application circuit 52 is connected to the transfer roller 24. When the recording paper is conveyed to the transfer nip portion, the transfer bias application circuit 52 applies a transfer bias to the transfer roller 24 based on a control signal from the printer controller 70. Specifically, the transfer roller functions as a transfer member, and the transfer bias application circuit 52 functions as a transfer bias application circuit.

The recording paper that is conveyed to the transfer nip portion is sandwiched by the outer circumferential surface of the photoreceptor drum 20 and the transfer roller 24, and is charged by the transfer bias via the transfer roller 24. Consequently, the toner image formed on the surface of the photoreceptor drum 20 is transferred to the recording paper based on electrostatic force. Moreover, since the recording paper is charged, the recording paper after the transfer tends to become affixed to the surface of the photoreceptor drum 20.

Figure 3:
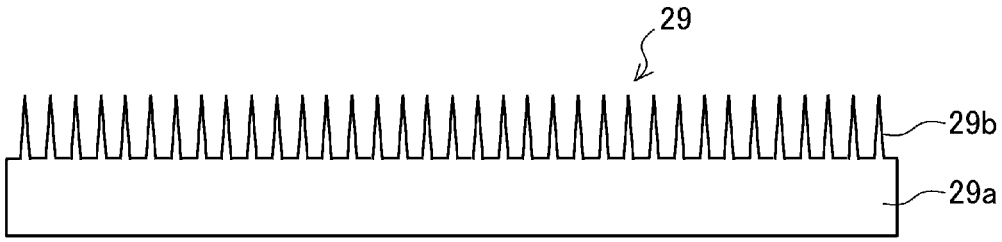
FIG. 3 is a schematic diagram showing the static elimination needle provided in the image forming apparatus according to the first preferred embodiment of the present invention.

Thus, a static elimination needle 29 for static elimination on the recording paper that was charged due to the transfer is provided to the downstream side of the transfer roller 24. FIG. 3 is a diagram showing the static elimination needle 29. The static elimination needle 29 includes a base end portion 29*a* extending in the longitudinal direction of the photoreceptor drum 20 and the transfer roller 24, and a plurality of needle-shaped portions 29*b* protruding in a needle-like manner from the base end portion 29*a*. The front end of the needle-shaped portions 29*b* is disposed to face the photoreceptor drum 20.

Figure 4:
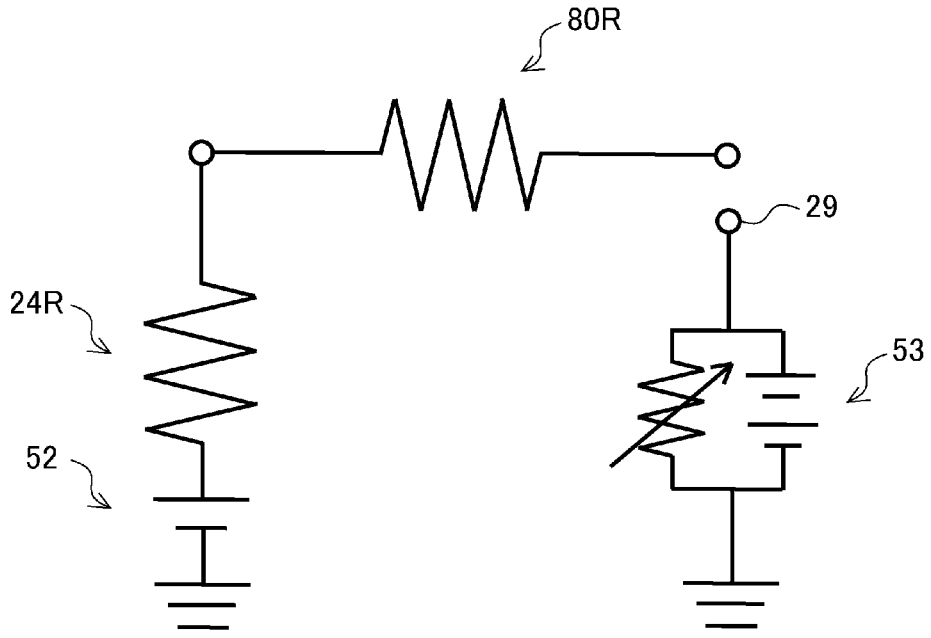
FIG. 4 is an equivalent circuit diagram including the static elimination bias application circuit in the image forming apparatus according to the first preferred embodiment of the present invention.

A static elimination bias application circuit 53 is connected to the static elimination needle 29. The static elimination bias application circuit 53 applies a static elimination bias of reverse polarity relative to the transfer bias to the static elimination needle 29 based on a control signal output from the printer controller 70. As shown in FIG. 4, the static elimination bias application circuit 53 includes a variable voltage circuit, and changes the value of the static elimination bias according to the control signal. The static elimination needle 29 to which the static elimination bias was applied eliminates static of the recording paper that passes in front of the static elimination needle 29. Specifically, the static elimination needle 29 functions as a static elimination member and the static elimination bias application circuit 53 functions as a static elimination bias application circuit.

Note that FIG. 4 is an equivalent circuit diagram including the static elimination bias application circuit 53, and shows the recording paper as a resistor 80R. Although the recording paper has a high resistance value under low temperature and low humidity, it absorbs moisture under high temperature and high humidity and its resistance value will decrease. The resistor 80R is connected to a resistor 24R corresponding to the transfer roller 24, and the resistor 24R is connected to the transfer bias application circuit 52.

The recording paper, the static of which is eliminated by the static elimination needle 29, is separated from the photoreceptor drum 20, and conveyed toward the conveyance guide provided to the downstream side of the static elimination needle 29. When the front end of the recording paper comes into contact with the conveyance guide 30, the recording paper is conveyed toward the fixing roller 26 disposed upward along the conveyance guide 30. Note that, even in cases where the recording paper of which static is eliminated is not separated, as a result of the recording paper being conveyed together with the rotation of the photoreceptor drum 20, the separating claw 31 provided to a side that is more downstream than the static elimination needle gains entry between the photoreceptor drum 20 and the recording paper from the front end side of the recording paper. Accordingly, it is possible to promote the separation.

The toner image transferred to the recording paper is heated and pressed by being sandwiched between the heated fixing roller 26 and press roller 32, and the toner image is fixed to the recording paper. A heater driving circuit 54 is connected to the fixing roller 26. The heater driving circuit 54 heats the heater lamp in the fixing roller 26 based on a control signal from the printer controller 70. A thermistor is disposed so as to contact with the surface in order to detect the surface temperature of the fixing roller 26. Based on the detection signal of the thermistor, the printer controller 70 controls the heater driving circuit 54 and maintains the surface temperature of the fixing roller 26 at a prescribed temperature. Note that the fixed recording paper is ejected to the recording paper receiving tray 35 by being sandwiched between a paper ejection roller pair 33, 34.

A cleaning blade 25 to collect the toner on the photoreceptor drum 20 is provided to the downstream side of the transfer roller 24 relative to the rotating direction of the photoreceptor drum 20. The cleaning blade 25 is, for example, a rubber blade, and comes into contact with the photoreceptor drum and scrapes and collects the residual toner on the photoreceptor drum 20.

The main motor 56 rotatably drives the photoreceptor drum 20, the supply roller 27, the development roller 28, and the transfer roller 24 configuring the development processing unit based on a control signal from the printer controller 70. Moreover, the pickup roller 17, the resist roller pair 18, 19, the fixing roller 26, the press roller 32, and the paper ejection roller pair 33, 34 configuring the recording paper conveyance unit are rotated in the direction of ejecting the recording paper by the rotational driving force from the sub motor 57.

The pickup roller 17 is connected to a sub motor 57 via a paper feed clutch 58. Based on a control signal from the printer controller 70, the paper feed clutch 58 transmits the driving force that is transmitted to the pickup roller 17 from the sub motor 57. The resist roller pair 18, 19 is connected to the sub motor 57 via a resist clutch 59. Based on a control signal from the printer controller 70, the resist clutch 59 transmits the driving force of the driving force that is transmitted to the resist roller pair 18, 19 from the sub motor 57.

Moreover, the image forming apparatus 1 includes a temperature sensor 61 to measure the temperature in the image forming apparatus 1 and a humidity sensor 62 to measure the humidity. The output value of the temperature sensor 61 and the humidity sensor 62 is output to the printer controller 70. The printer controller 70 is thereby able to control based on the environmental conditions including the temperature and humidity that will have an effect upon forming an image on the recording paper. Note that the temperature sensor 61 and the humidity sensor 62 function as a detector to detect the environmental conditions.

The printer controller 70 performs the drive control of the main motor 56 and the sub motor 57 as described above, and executes the image forming process by controlling the exposure head 22, the charging bias application circuit 50, the developing bias application circuit 51, the transfer bias application circuit 52, the static elimination bias application circuit 53 and the heater driving circuit 54.

The printer controller 70 preferably is configured from a microcomputer which performs computation, a ROM which stores programs and the like for causing the microprocessor to execute various types of processing, a RAM which temporarily stores various types of data such as computation results, and a backup RAM in which data is backed up. The printer controller 70 integrally controls the hardware configuring the foregoing image forming apparatus 1 by executing the programs stored in the ROM, and performs processing for forming an image on the recording paper.

Figure 5:
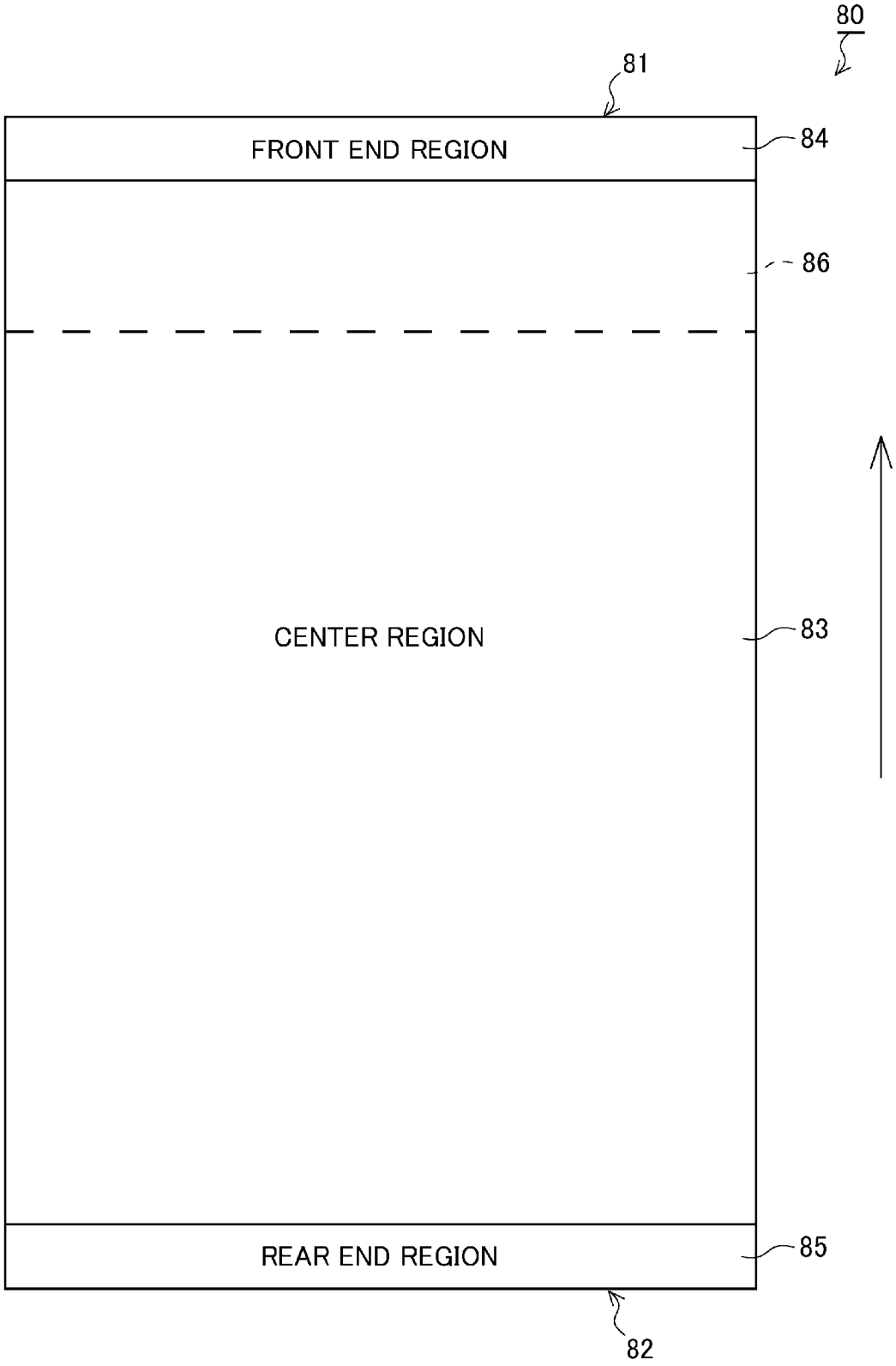
FIG. 5 is a diagram showing the regions of the recording paper used by the image forming apparatus according to the first preferred embodiment of the present invention.

FIG. 5 shows the recording paper 80 on which printing is performed by the image forming apparatus 1. The end as the front side upon feeding the recording paper 80 in the image forming apparatus 1 is referred to as a front end 81, and the end as the rear side is referred to as a rear end 82. The recording paper 80 can be divided into a center region 83 to which an image is printed, a front end region 84 that is more on the front end 81 side than the center region 83, and a rear end region 85 that is more on the rear end 82 side than the center region 83.

The center region 83 is a transfer region where the toner image is transferred. The front end region 84 and the rear end region 85 are marginal regions that are set as regions where the toner image is not transferred. The front end region 84 is a region of approximately 3 mm from the front end 81, and the rear end region 85 is a region of approximately 3 mm from the rear end 82, for example. Note that the region 86 on the front end side in the center region 83 is the region that passes by the static elimination needle 29 during the period from when the front end side of the center region 83 passes by the static elimination needle 29 until when the front end 81 comes into contact with the conveyance guide 30.

Figure 6:
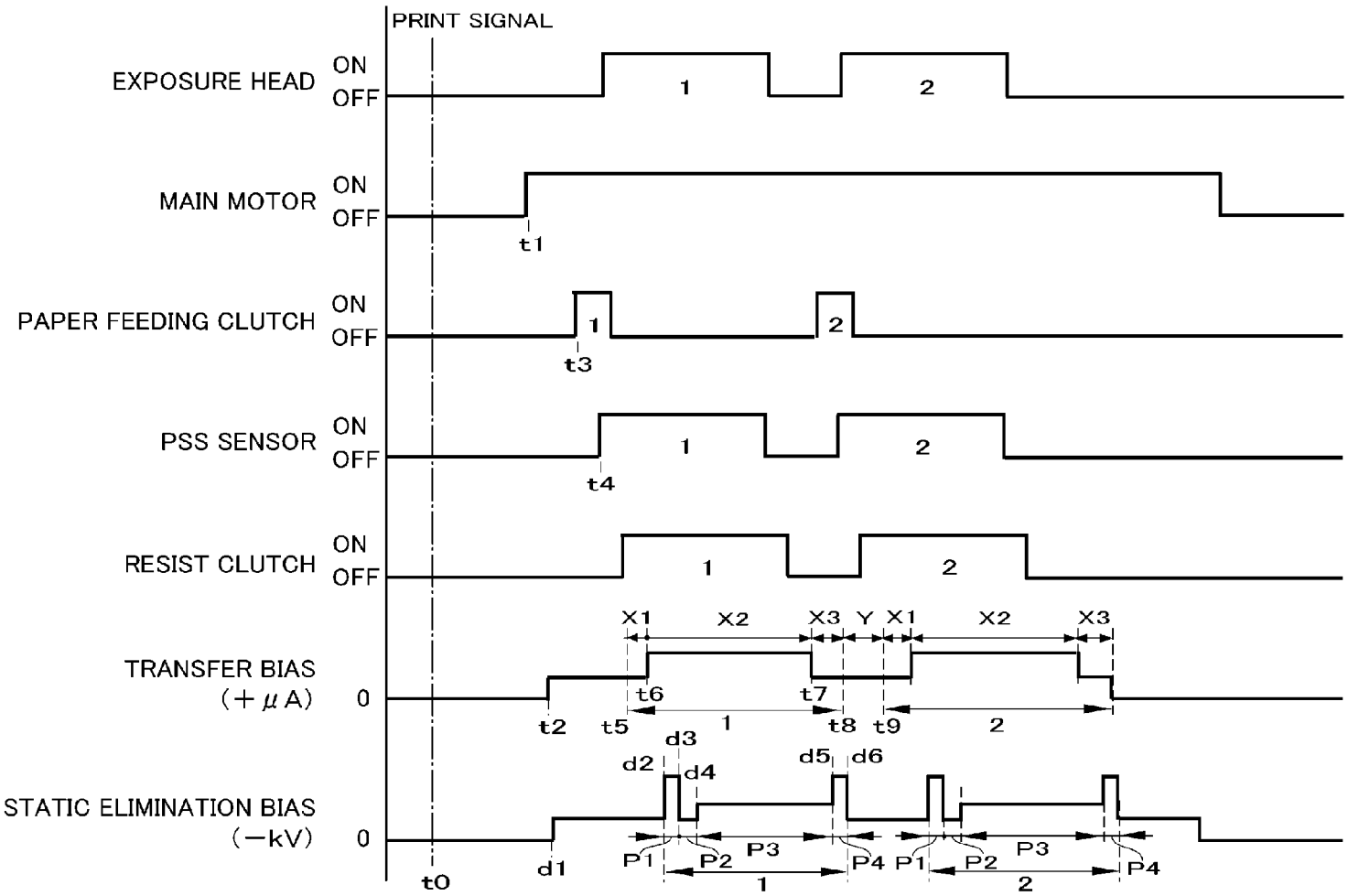
FIG. 6 is a timing chart showing the operation of the image forming apparatus according to the first preferred embodiment of the present invention.

The operation of the image forming apparatus 1 is now explained with reference to FIG. 6, and the control of the transfer bias application circuit 52 and the static elimination bias application circuit 53 by the printer controller 70 is also explained in detail. FIG. 6 shows a timing chart in the case of performing print processing consecutively to two sheets of recording paper in the image forming apparatus 1.

In FIG. 6, the horizontal axis is the time, and the ON/OFF state of the exposure head 22, the main motor 56, the paper feed clutch 58, the PSS sensor 60, and the resist clutch 59 is shown. With respect to the transfer bias, the vertical axis shows the absolute value of the value that is applied from the transfer bias application circuit 52 to the transfer roller 24. With respect to the static elimination bias, the vertical axis shows the absolute value of the value that is applied from the static elimination bias application circuit 53 to the static elimination needle 29. Note that the numbers "1" and "2" in FIG. 6 respectively show the recording paper 80 corresponding to the first sheet and the recording paper 80 corresponding to the second sheet.

Foremost, when a print signal is input to the printer controller 70 (t0) and the temperature of the fixing roller 26 reaches a prescribed value, a drive signal is output to the main motor 56. The rotation of the main motor 56 is thereby started (t1). The photoreceptor drum 20 starts to rotate by the driving force of the main motor 56 and the charge processing of the photoreceptor drum 20 is also started. Moreover, the cleaning of the transfer roller 24 is started at time t1. Moreover, in order to execute the cleaning processing of returning the oppositely-charged toner on the transfer roller 24 to the photoreceptor drum 20, a transfer bias of approximately +5.0 μA is applied to the transfer roller 24 by the transfer bias application circuit 52 (t2).

Meanwhile, as a result of the paper feed clutch 58 being engaged (turned ON) (t3), the first sheet of recording paper is supplied to the paper feeding path from the recording paper cassette 15 by the pickup roller 17. Then, after the front end 81 of the recording paper 80 is detected by the PSS sensor 60 (t4), the front end 81 of the recording paper 80 comes into contact with the resist roller pair 18, 19 in a state where the rotation is stopped, and the orientation of the recording paper 80 is corrected to an appropriate position. Subsequently, when a prescribed time elapses from t4, the resist roller pair 18, 19 starts to rotate as a result of the resist clutch 59 being engaged (turn ON), and the recording paper 80 is conveyed to the transfer position.

Moreover, the resist clutch 59 is engaged, the exposure head 22 is turned ON, and the exposure processing to the photoreceptor drum 20 is started. Subsequently, the development processing is performed to the photoreceptor drum 20, a toner image is formed on the outer circumferential surface of the photoreceptor drum 20, and the region where the toner image was formed is rotated toward the transfer position.

Meanwhile, when the resist clutch 59 is engaged, the front end 81 of the first sheet of the recording paper 80 reaches the transfer nip portion (t5). In addition, the front end 81 of the recording paper 80 is sandwiched between the photoreceptor drum 20 and the transfer roller 24, and passes through the transfer roller 24. During the period (X1) that the front end region 84 of the recording paper 80 passes through the transfer roller 24, a transfer bias of approximately +5.0 μA is continuously applied to the transfer roller 24 by the transfer bias application circuit 52. The front end region 84 of the recording paper 80 that is in contact with the transfer roller 24 is thereby charged.

Subsequently, in accordance with the timing that the front end side of the center region 83 of the recording paper 80 reaches the transfer nip portion, the region where the toner image was formed in the photoreceptor drum 20 reaches the transfer nip portion. Simultaneously, the transfer bias that was raised to the transfer bias (approximately +10 μA) that was set based on the environmental conditions is applied from the transfer bias application circuit 52 to the transfer roller 24 (t6). In addition, during the period (X2) that the center region 83 passes through the transfer roller 24, the transfer bias that was set based on the environmental conditions is applied to the transfer roller 24.

Since the transfer bias to be applied to the transfer roller 24 is raised to a value that was set based on the environmental conditions, the center region 83 of the recording paper 80 is charged more strongly than the front end region 84. As a result of the center region 83 being charged, the toner image is transferred to the recording paper 80 by electrostatic force. Note that the value that is set based on the environmental conditions is set by the printer controller 70 based on the temperature and humidity that are input from the temperature sensor 61 and the humidity sensor 62, and a transfer bias table. In the transfer bias table, the transfer bias is set to be higher under environmental conditions of higher temperature and higher humidity.

At the timing that the front end side of the rear end region 85 of the recording paper 80 reaches the transfer nip portion, the transfer bias that was lowered to approximately +5.0 μA is once again applied to the transfer roller 24 (t7). During the period (X3) that the rear end region 85 passes through the transfer roller 24, the transfer bias that is smaller than the bias voltage being applied during the period that the center region 84 passes through the transfer roller 24 is applied to the transfer roller 24. Consequently, the electrified charge amount of the rear end region 85 of the recording paper 80 that is in contact with the transfer roller 24 becomes smaller than the electrified charge amount of the center region 83. Thus, the recording paper 80 can be separately from the photoreceptor drum 20 more easily.

During the period (Y) from when the rear end 82 of the first sheet of the recording paper 80 passes through the transfer nip portion (t8) until when the front end 81 of the second sheet of the recording paper 80 reaches the transfer nip portion (t9), a transfer bias of approximately +5.0 μA is continuously applied from the transfer bias application circuit 52 to the transfer roller 24. When the front end 81 of the second sheet of the recording paper 80 reaches the transfer nip portion (t9), the same control as the first sheet is performed.

Figure 7:
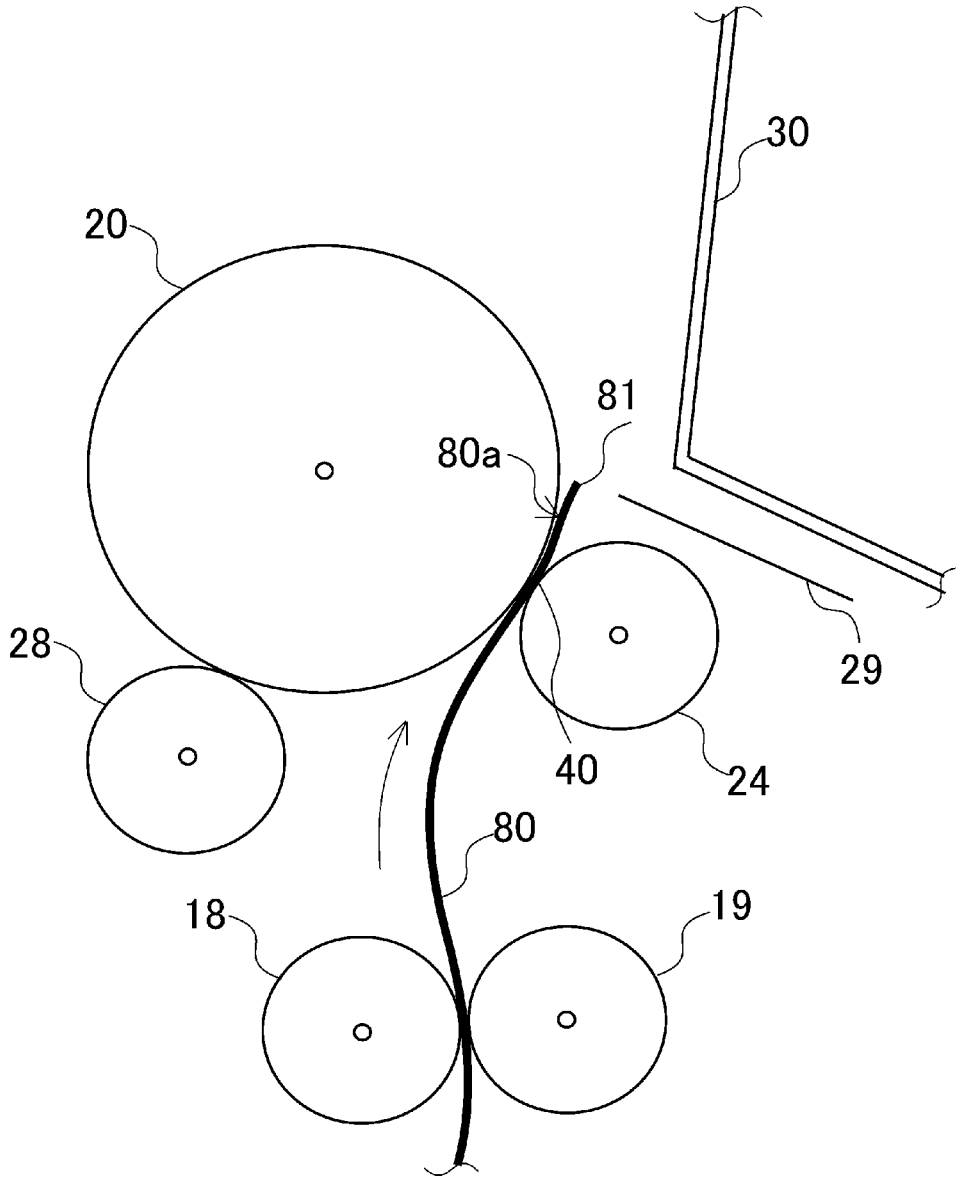
FIG. 7 is a diagram explaining the movement of the recording paper in the image forming apparatus according to the first preferred embodiment of the present invention.
Figure 8:
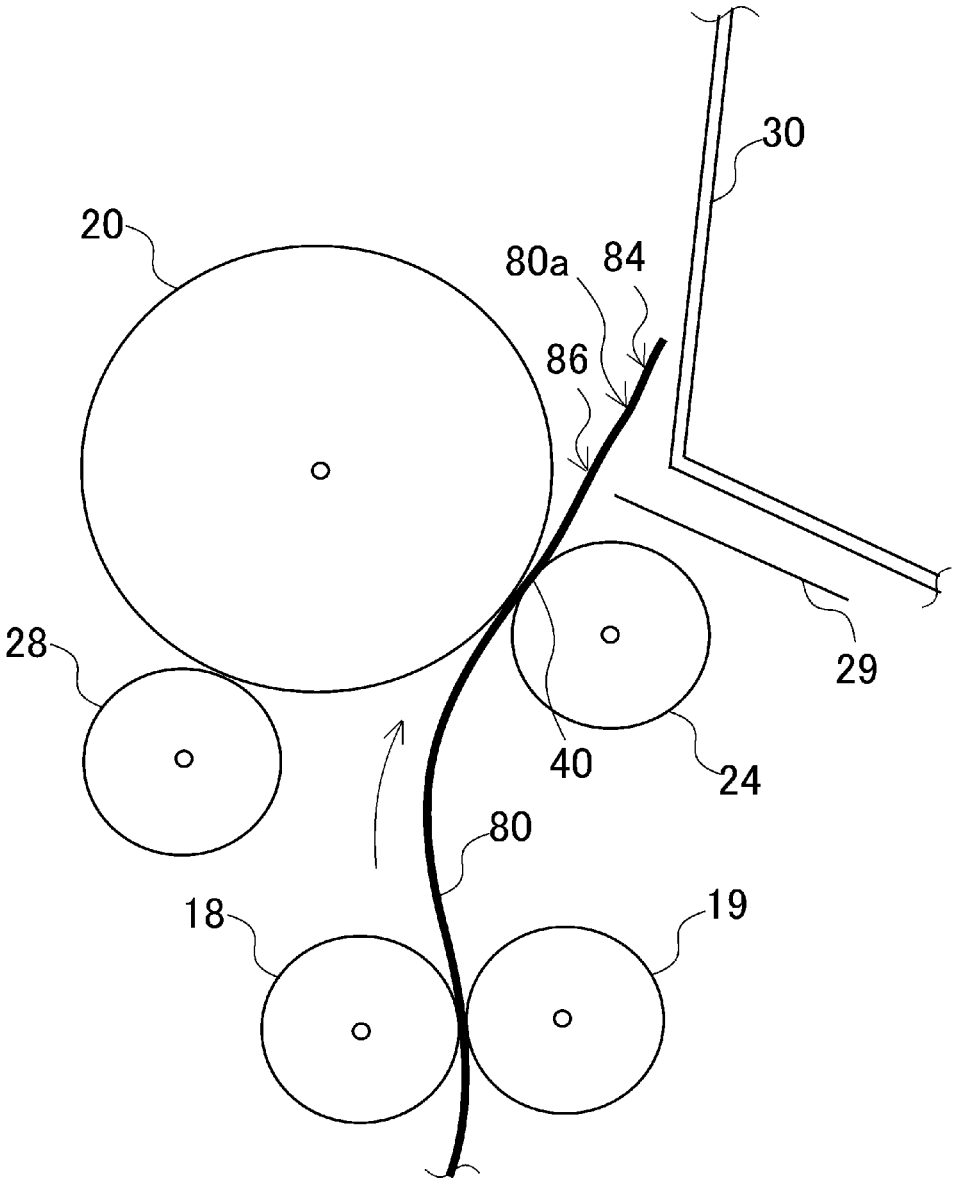
FIG. 8 is a diagram explaining the movement of the recording paper in the image forming apparatus according to the first preferred embodiment of the present invention.
Figure 9:
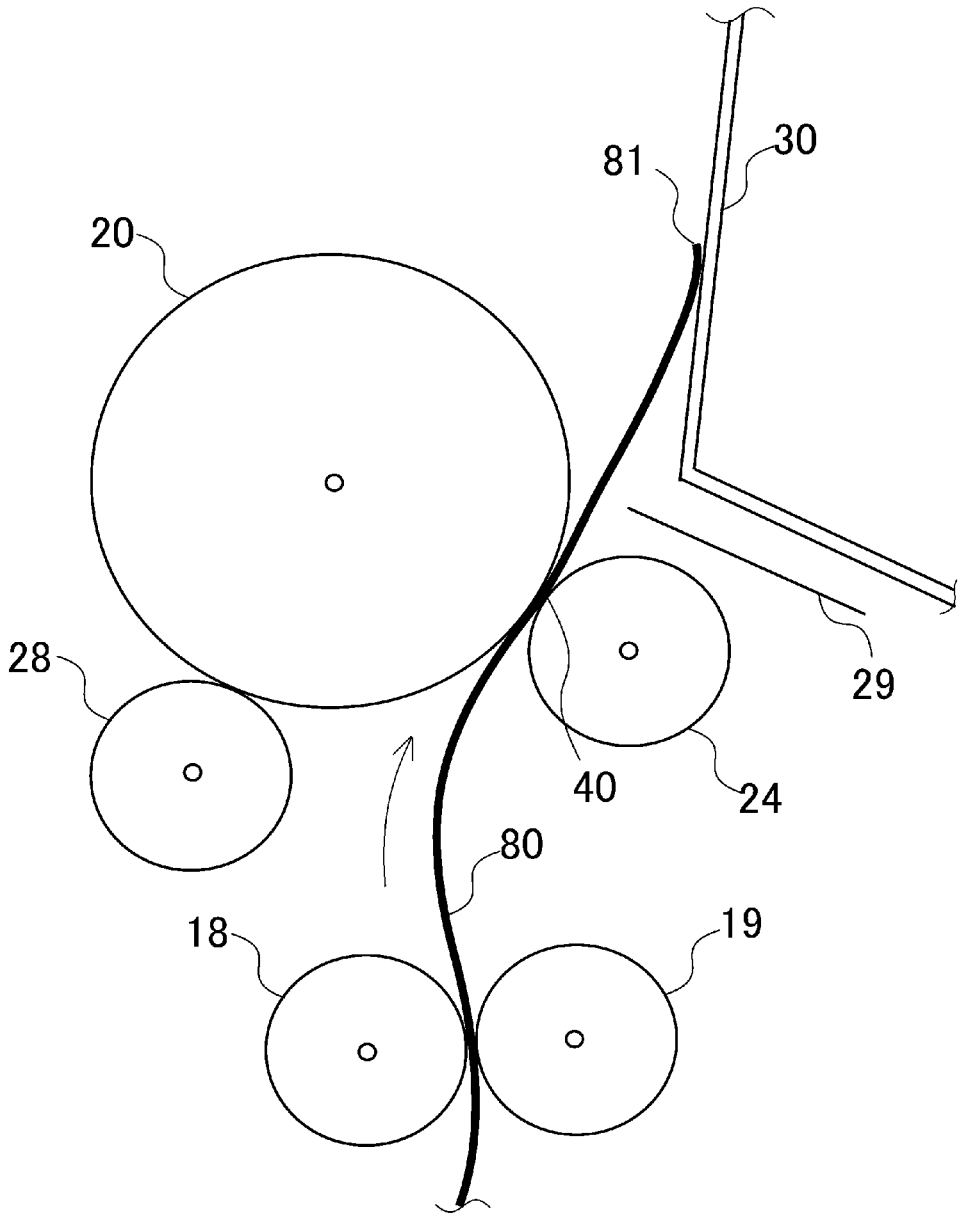
FIG. 9 is a diagram explaining the movement of the recording paper in the image forming apparatus according to the first preferred embodiment of the present invention.

With reference to FIG. 7 to FIG. 9 in addition to FIG. 6, the control of the static elimination bias application circuit is now explained. FIG. 7 to FIG. 9 are sequential diagrams explaining the movement of the recording paper in the image forming apparatus according to the first preferred embodiment.

During the period after the drive of the main motor 56 is started and a prescribed time has elapsed (d1) and until the front end 81 of the first sheet of the recording paper 80 reaches the static elimination needle 29, a static elimination bias of approximately −0.5 kV is applied from the static elimination bias application circuit 53 to the static elimination needle 29. Since the portion 80*a* of the first sheet of the recording paper 80 that passed through the transfer nip portion 40 is charged, it tends to become affixed to the photoreceptor drum 20. In this state, the front end 81 of the recording paper 80 reaches the front of the static elimination needle 29 (FIG. 7).

At the timing of the front end 81 of the recording paper 80 reaching the front of the static elimination needle 29, the static elimination bias is raised from about −0.5 kV to about −2.5 kV (d2). Then, during the period (P1) that the front end region 84 of the first sheet of the recording paper 80 passes by the front of the static elimination needle 29, a static elimination bias of approximately −2.5 kV is applied from the static elimination bias application circuit 53 to the static elimination needle 29. Since the static of the front end region of the recording paper 80 is thereby eliminated, the electrostatic force between the front end region 84 of the recording paper 80 and the photoreceptor drum 20 decreases, and the front end region 84 of the recording paper 80 is separated from the photoreceptor drum 20.

After the front end region 84 of the recording paper 80 is separated from the photoreceptor drum 20, it is conveyed obliquely upward, comes into contact with the conveyance guide 30 having a plane that is disposed substantially vertically, and conveyed while being supported by the conveyance guide 30. When the front end region 84 is separated from the photoreceptor drum 20, the posture of the portion 80*a* of the recording paper 80 that passed through the transfer nip portion 40 becomes an unstable state until the front end 81 comes into contact with the conveyance guide 30. Thus, the recording paper 80 is easily drawn toward the static elimination needle 29.

Thus, at the timing that the front end side of the center region 83 reaches the static elimination needle 29, the static elimination bias is lowered from about −2.5 kV to about −1.0 kV (d3). Consequently, since the electrostatic force that attracts the recording paper 80 is reduced in the static elimination needle 29, it is possible to prevent the recording paper 80 from getting unnecessarily close to the static elimination needle 29. In other words, it is possible to prevent a closed circuit connecting the transfer roller 24, the recording paper 80, and the static elimination needle 29 from being formed.

The value of the static elimination bias is maintained at about −1.0 kV (P2; FIG. 8) up to the timing (d4) that the front end 81 of the recording paper 80 comes into contact with the conveyance guide 30. After the front end 81 of the recording paper 80 comes into contact with the conveyance guide 30, the recording paper 80 is supported by the conveyance guide 30 and, therefore, it is conveyed upward in a state where its posture is stable (FIG. 9). Thus, the foregoing closed circuit is not formed.

At the timing (d4) that the front end 81 of the recording paper 80 comes into contact with the conveyance guide 30, the static elimination bias is raised from about −1.0 kV to a value according to the environmental conditions. The value according to the environmental conditions is set by the printer controller 70 based on the temperature and humidity that are input from the temperature sensor 61 and the humidity sensor 62, and a static elimination bias table. As the temperature or humidity becomes high, it becomes difficult for the recording paper 80 to become separated from the photoreceptor drum 20. Thus, in the static elimination bias table, the static elimination bias is set to be higher under environmental conditions of higher temperature and higher humidity.

Subsequently, at the timing that the front end side of the rear end region 85 of the recording paper 80 reaches the static elimination needle 29, the static elimination bias is raised up to about −2.5 kV (d5). Then, during the period (P4) that the rear end region 85 passes in front of the static elimination needle 29, a static elimination bias of approximately −2.5 kV is applied from the static elimination bias application circuit 53 to the static elimination needle 29. Accordingly, the recording paper 80 can be easily separated.

During the period from when the rear end 82 of the first sheet of the recording paper 80 passes by the static elimination needle 29 (d6) until when the front end 81 of the second sheet of the recording paper 80 reaches the static elimination needle 29, a static elimination bias of approximately −0.5 kV is applied from the static elimination bias application circuit 53 to the static elimination needle 29. As a result of the same control is performed to the second sheet of the recording paper 80, the second sheet of the recording paper 80 can also be easily separated from the photoreceptor drum 20.

Note that the printer controller 70 performs the foregoing control by using the output of a timer and the PSS sensor 60 to measure the timing that the respective positions of the recording paper 80 reaches the transfer roller 24 and passes by the static elimination needle 29.

The operation and advantageous effects of the image forming apparatus 1 according to this preferred embodiment are now explained. After the front end region 84 of the recording paper 80 is separated from the photoreceptor drum 20, until the front end of the recording paper 80 comes into contact with the conveyance guide 30, the posture of the portion 80*a* of the recording paper 80 that passed through the transfer nip portion 40 becomes unstable. Thus, the printer controller 70 controls the static elimination bias application circuit 53 so that the static elimination bias that is applied during the period from when the front end region 84 of the recording paper 80 passes by the static elimination needle 29 until when the front end 81 of the recording paper 80 comes into contact with the conveyance guide becomes smaller than the static elimination bias that is applied while the front end region 84 of the recording paper 80 passes by the static elimination needle 29.

Consequently, the potential difference between the static elimination needle 29 and the recording paper 80 during the period from when the front end region 84 of the recording paper 80 passes by the static elimination needle 29 until when the front end 81 of the recording paper 80 comes into contact with the conveyance guide 30 to be smaller than the potential difference while the front end region 84 of the recording paper 80 passes by the static elimination needle 29. Accordingly, it is possible to prevent the portion of the recording paper 80 in which the posture is unstable from being drawn toward the static elimination needle 29, and prevent a closed circuit connecting the transfer roller 24, the recording paper 80, and the static elimination needle 29 from being formed. In other words, it is possible to prevent the electric charge that was supplied to the recording paper 80 via the transfer roller 24 from flowing to the static elimination needle 29. Accordingly, it is possible to prevent the effective charge amount to transfer the toner to the recording paper from decreasing, and to prevent transfer defects such as white spots.

Moreover, when the front end 81 of the recording paper 80 comes into contact with the conveyance guide 30, the posture of the portion 80*a* of the recording paper 80 that passed through the transfer nip portion 40 becomes stable since it is supported by the conveyance guide 30. In this state, since the static elimination bias that was set based on the environmental conditions is applied to the static elimination needle 29, the static of the recording paper can be eliminated according to the environmental conditions so that the recording paper 80 is easily separated from the photoreceptor drum 20.

Figure 10:
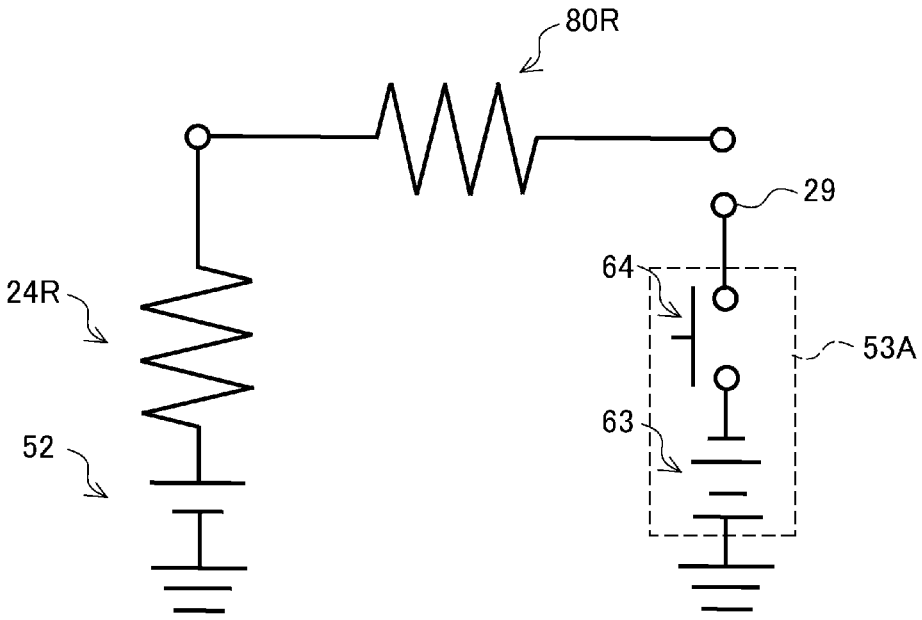
FIG. 10 is an equivalent circuit diagram including a first modified example of the static elimination bias application circuit provided in the image forming apparatus according to the first preferred embodiment of the present invention.

Note that the control of the static elimination bias can be modified variously. As a first modified example, the printer controller 70 can also control the static elimination bias application circuit so that the value of the static elimination bias that is applied becomes 0 during the period from when the front end region 84 of the recording paper 80 passes by the static elimination needle 29 until when the front end 81 of the recording paper 80 comes into contact with the conveyance guide 30. FIG. 10 is an equivalent circuit including the first modified example of the static elimination bias application circuit.

The static elimination bias application circuit 53A includes a high voltage power source 63 that applies a static elimination bias of about −2.5 kV while the front end region 84 of the recording paper 80 passes in front of the static elimination needle 29, and a switch 64 that disconnects the connection between the high voltage power source 63 and the static elimination needle 29 during the period from when the front end region 84 of the recording paper 80 passes by the static elimination needle 29 until when the front end of the recording paper 80 comes into contact with the conveyance guide 30.

Even in the case, the potential difference between the static elimination needle 29 and the recording paper 80 during the period from when the front end region 84 of the recording paper 80 passes the front the static elimination needle 29 until when the front end 81 of the recording paper 80 comes into contact with the conveyance guide 30 can be made to be smaller than the potential difference while the front end region 84 of the recording paper 80 passes by the static elimination needle 29. Accordingly, it is possible to prevent transfer defects such as white spots.

Figure 11:
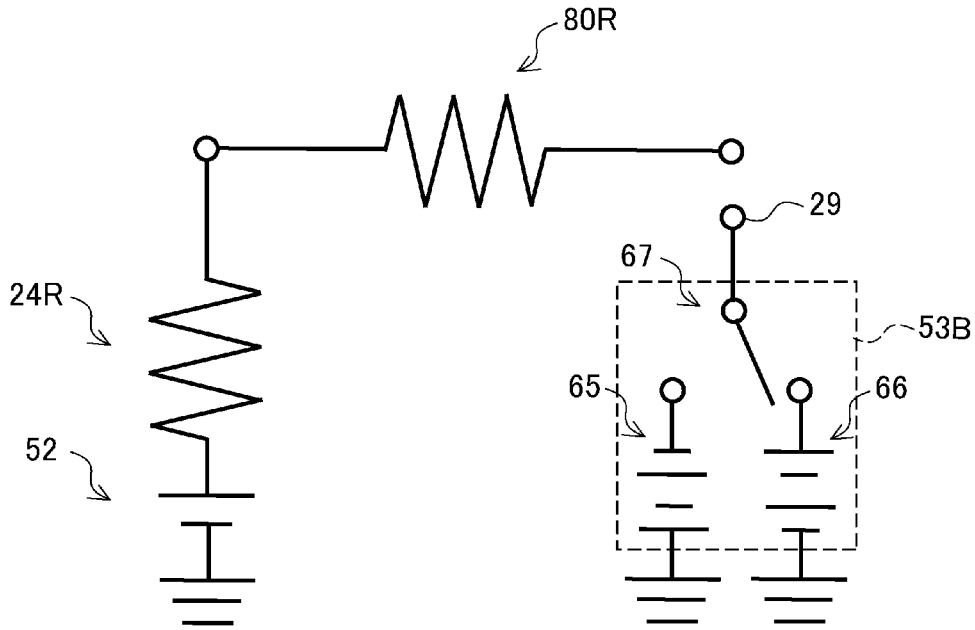
FIG. 11 is an equivalent circuit diagram including a second modified example of the static elimination bias application circuit provided in the image forming apparatus according to the first preferred embodiment of the present invention.

In a second modified example, the printer controller 70 applies a static elimination bias of reverse polarity relative to the transfer bias to the static elimination needle 29 while the front end region 84 of the recording paper 80 passes by the static elimination needle 29. In addition, during the period from when the front end region 84 of the recording paper 80 passes by the static elimination needle 29 until when the front end 81 of the recording paper 80 comes into contact with the conveyance guide 30, the printer controller 70 controls the static elimination bias application circuit so as to apply a bias of the same polarity as the transfer bias to the static elimination needle 29. FIG. 11 is an equivalent circuit diagram including the static elimination bias application circuit 53B according to the second modified example.

The static elimination bias application circuit 53B includes a high voltage power source 65 that applies a static elimination bias of reverse polarity relative to the transfer bias, a high voltage power source 66 that applies a static elimination bias of the same polarity as the transfer bias, and a switch 67. The switch 67 is used to switch between the case of connecting the static elimination needle 29 to the high voltage power source 65 and the case of connecting the static elimination needle 29 to the high voltage power source 66.

Even in the foregoing case, the potential difference between the static elimination needle 29 and the recording paper 80 during the period from when the front end region 84 of the recording paper 80 passes the front the static elimination needle 29 until when the front end 81 of the recording paper 80 comes into contact with the conveyance guide 30 can be made to be smaller than the potential difference while the front end region of the recording paper 80 passes by the static elimination needle 29. Accordingly, it is possible to prevent transfer defects such as white spots.

Second Preferred Embodiment

The first preferred embodiment described the image forming apparatus 1 which prevents the effective charge amount to transfer the toner to the recording paper from decreasing by controlling the static elimination bias. The image forming apparatus according to the second preferred embodiment prevents the effective charge amount from decreasing by controlling the transfer bias.

Figure 12:
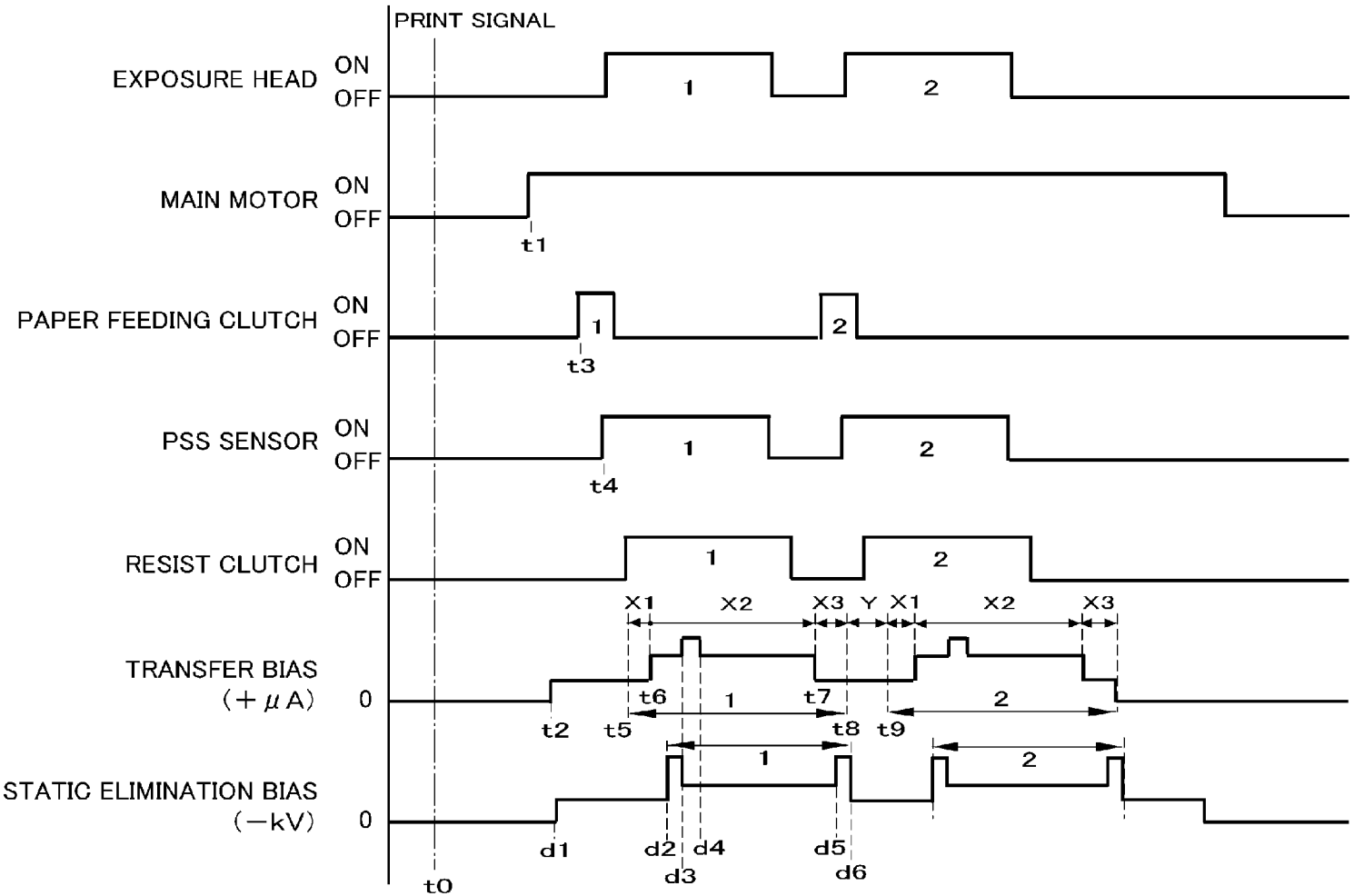
FIG. 12 is a timing chart showing the operation of the image forming apparatus according to a second preferred embodiment of the present invention.

The operation of the image forming apparatus according to the second preferred embodiment is now explained with reference to FIG. 12, and the control of the transfer bias application circuit 52 and the static elimination bias application circuit 53 by the printer controller 70 is also explained in detail. FIG. 12 shows a timing chart in the case of performing print processing consecutively to two sheets of recording paper in the image forming apparatus. Note that the points that are different from the image forming apparatus 1 according to the first preferred embodiment are mainly explained, and the explanation of the same points is omitted.

When the photoreceptor drum 20 starts to rotate by the driving force of the main motor 56, in order to execute the cleaning processing of returning the oppositely-charged toner on the transfer roller 24 to the photoreceptor drum 20, a transfer bias of approximately +5.0 μA is applied to the transfer roller 24 by the transfer bias application circuit 52 (t2). After the resist clutch 59 is engaged, during the period that the front end region 84 of the recording paper 80 passes through the transfer roller 24, a transfer bias of approximately +5.0 μA is continuously applied to the transfer roller 24 by the transfer bias application circuit 52.

Subsequently, at the timing that the front end side of the center region 83 of the recording paper 80 reaches the transfer nip portion 40, the transfer bias that was raised to a value set according to the environmental conditions is applied from the transfer bias application circuit 52 to the transfer roller 24 (t6). Then, at the timing that the front end side of the center region 83 reaches the static elimination needle 29, the transfer bias is raised from the value that was set according to the environmental conditions to approximately +15 μA (d3).

Consequently, even if the portion of the recording paper 80 where the posture is of an unstable state is drawn toward the static elimination needle 29 and a closed circuit is formed, and the electric charge on the recording paper 80 escapes to the static elimination needle 29, the electric charge from the transfer bias application circuit 52 is replenished in the recording paper 80. Subsequently, at the timing that the front end 81 of the recording paper 80 comes into contact with the conveyance guide 30, the transfer bias is once again lowered from approximately +15 μA to the value that was set according to the environmental conditions (d4).

At the timing that the front end side of the rear end region 85 of the recording paper 80 reaches the transfer nip portion 40, the transfer bias that was lowered to approximately +5.0 μA is once again applied to the transfer roller 24 (t7). During the period (Y) from when the rear end 82 of the first sheet of the recording paper 80 passes through the transfer nip portion 40 (t8) until when the front end 81 of the second sheet of the recording paper 80 reaches the transfer nip portion 40 (t9), a transfer bias of approximately +5.0 μA is continuously applied from the transfer bias application circuit 52 to the transfer roller 24. When the front end 81 of the second sheet of the recording paper 80 reaches the transfer nip portion 40 (t9), the same control as the first sheet is performed.

Meanwhile, with respect to the static elimination bias, at the timing of the front end 81 of the recording paper 80 reaching the static elimination needle 29, the static elimination bias is raised from about −0.5 kV to about −2.5 kV (d2). Then, during the period (P1) that the front end region 84 of the first sheet of the recording paper 80 passes by the static elimination needle 29, a static elimination bias of approximately −2.5 kV is applied from the static elimination bias application circuit 53 to the static elimination needle 29. Then, at the timing that the front end side of the center region 83 reaches the static elimination needle 29, the static elimination bias is lowered to the value that was set according to the environmental conditions (d3).

Subsequently, at the timing that the front end side of the rear end region 85 of the recording paper 80 reaches the static elimination needle 29, the static elimination bias is raised to about −2.5 kV (d5). During the period from when the rear end 82 of the first sheet of the recording paper 80 passes by the static elimination needle 29 (d6) until when the front end of the second sheet of the recording paper 80 reaches the static elimination needle 29, a static elimination bias of approximately −0.5 kV is applied from the static elimination bias application circuit 53 to the static elimination needle 29. The same control is thereafter performed to the second sheet of the recording paper 80.

As explained above, in the image forming apparatus according to the second preferred embodiment, the printer controller 70 controls the transfer bias application circuit 52 so that the transfer bias that is applied during the period from when the front end region 84 of the recording paper 80 passes by the static elimination needle 29 until when the front end 81 of the recording paper 80 comes into contact with the conveyance guide 30 becomes greater than the transfer bias that is applied after the front end 81 of the recording paper 80 comes into contact with the conveyance guide 30.

Consequently, the charge amount that is supplied to the recording paper 80 from the transfer roller 24 during the period from when the front end region 84 of the recording paper 80 passes by the static elimination needle 29 until when the front end 81 of the recording paper 80 comes into contact with the conveyance guide 30 can be made to be greater than the charge amount that is supplied after the front end 81 of the recording paper 80 comes into contact with the conveyance guide 30. Thus, even if the portion of the recording paper 80 in which the posture is of an unstable state is drawn toward the static elimination needle 29 and the closed circuit is formed and the electric charge flows to the static elimination needle 29 from the recording paper 80, the electric charge is replenished in the recording paper 80. It is thereby possible to prevent the effective charge amount to transfer the toner to the recording paper from decreasing. Accordingly, it is possible to prevent transfer defects such as white spots.

In a modified example of the second preferred embodiment, the printer controller 70 controls the transfer bias application circuit 52 based on constant voltage control during the period from when the front end region 84 of the recording paper 80 passes by the static elimination needle 29 until when the front end 81 of the recording paper 80 comes into contact with the conveyance guide 30. Moreover, after the front end 81 of the recording paper 80 comes into contact with the conveyance guide 30, the printer controller 70 controls the transfer bias application circuit 52 based on constant current control.

According to the configuration of the second preferred embodiment of the present invention, when the portion of the recording paper 80 in which the posture is of an unstable state is drawn toward the static elimination needle 29 and the closed circuit is formed, the electric charge from the recording paper flows to the static elimination needle. However, since the control is performed so that the recording paper 80 will be a constant potential, it is possible to replenish the electric charge in the recording paper 80 for the amount that flowed to the static elimination needle 29. It is thereby possible to prevent the effective charge amount to transfer the toner to the recording paper from decreasing. Accordingly, it is possible to prevent transfer defects such as white spots.

Moreover, since a transfer bias is set based on the environmental conditions that will affect the transfer after the front end 81 of the recording paper 80 comes into contact with the conveyance guide 30, the transfer can be performed favorably, and the image quality can be improved.

Note that, although the first and second preferred embodiments preferably include both a temperature sensor 61 and a humidity sensor 62 to measure the environmental conditions, it is not necessary to include both, and the configuration may be such that only one is provided. Moreover, the behavior of the transfer roller 24 in which its resistance value changes according to the change in the temperature and humidity can also be used for detecting the environmental conditions. As a transfer roller that is noteworthy of having the foregoing behavior, there is an ion conductive roller. In this case, the transfer bias that is set based on the value of current flowing in the transfer roller 24 when a test voltage is applied to the transfer roller 24 is applied to the transfer roller 24.

Moreover, the static elimination bias can be controlled as with the first preferred embodiment and the transfer bias can be controlled as with the second preferred embodiment. In this case also, it is possible to prevent the effective charge amount to transfer the toner to the recording paper from decreasing.

Moreover, although the image forming apparatus 1 was preferably used as a printer in the first and second preferred embodiments, it may also be used as a multifunction machine comprising the functions of a copier, facsimile and printer, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An image forming apparatus for electrophotographically forming an image on recording paper, comprising:

a photoreceptor drum including an outer circumferential surface on which a toner image is formed;

a transfer member which is provided in contact with the photoreceptor drum and transfers the toner image formed on the outer circumferential surface of the photoreceptor drum to the recording paper;

a transfer bias application circuit that applies a transfer bias to the transfer member;

a static elimination member which is disposed on a side that is more downstream in a conveyance direction of the recording paper than the transfer member and which eliminates static from the recording paper to which the toner image has been transferred;

a static elimination bias application circuit that applies a static elimination bias to the static elimination member;

a conveyance guide which is disposed on a side that is more downstream than the static elimination member and which guides the conveyance of the recording paper that has passed by the static elimination member; and a controller arranged and programmed to control the static elimination bias application circuit so that a potential difference between the static elimination member and the recording paper during a first period from when a front end region of the recording paper has passed by the static elimination member until when a front end of the recording paper comes into contact with the conveyance guide becomes smaller than the potential difference during a second period when the front end region of the recording paper begins passing the static elimination member; wherein the controller controls the static elimination bias application circuit so that the static elimination bias of reverse polarity relative to the transfer bias is applied to the static elimination member during the second period when the front end region of the recording paper begins passing the static elimination member, and so that a bias of the same polarity as the transfer bias is applied to the static elimination member during the first period from when the front end region of the recording paper has passed by the static elimination member until when the front end of the recording paper comes into contact with the conveyance guide.

2. The image forming apparatus according to claim 1, wherein the static elimination bias is a bias of reverse polarity relative to the transfer bias, and the controller controls the static elimination bias application circuit so that an absolute value of the static elimination bias that is applied during the first period from when the front end region of the recording paper has passed by the static elimination member until when the front end of the recording paper comes into contact with the conveyance guide becomes smaller than an absolute value of the static elimination bias that is applied during the second period when the front end region of the recording paper begins passing the static elimination member.

3. The image forming apparatus according to claim 1, wherein the controller controls the static elimination bias application circuit so that the static elimination bias of reverse polarity relative to the transfer bias is applied to the static elimination member during the second period when the front end region of the recording paper begins passing the static elimination member, and so that a value of the static elimination bias that is applied to the static elimination member becomes 0 during the first period from when the front end region of the recording paper has passed by the static elimination member until when the front end of the recording paper comes into contact with the conveyance guide.

4. The image forming apparatus according to claim 1, further comprising a detector arranged to detect environmental conditions including at least one of either temperature or humidity, wherein the controller controls the static elimination bias application circuit so that the static elimination bias which is set based on the environmental conditions detected by the detector is applied to the static elimination member after the front end of the recording paper comes into contact with the conveyance guide.

5. The image forming apparatus according to claim 1, wherein the controller controls the static elimination bias application circuit so that the static elimination bias which is set based on a value of current flowing in the transfer member when a test voltage is applied to the transfer member is applied to the static elimination member after the front end of the recording paper comes into contact with the conveyance guide.

6. An image forming apparatus for electrophotographically forming an image on recording paper, comprising:

a photoreceptor drum including an outer circumferential surface on which a toner image is formed;

a transfer member which is provided in contact with the photoreceptor drum and transfers the toner image formed on the outer circumferential surface of the photoreceptor drum to the recording paper;

a transfer bias application circuit that applies a transfer bias to the transfer member;

a static elimination member which is disposed on a side that is more downstream in a conveyance direction of the recording paper than the transfer member and which eliminates static of the recording paper to which the toner image has been transferred;

a static elimination bias application circuit that applies a static elimination bias to the static elimination member;

a conveyance guide which is disposed on a side that is more downstream than the static elimination member and which guides the conveyance of the recording paper that has passed by the static elimination member; and a controller arranged and programmed to control the transfer bias application circuit so that an absolute value of the transfer bias that is applied during the period from when a front end region of the recording paper passes by the static elimination member until when a front end of the recording paper comes into contact with the conveyance guide becomes greater than the absolute value of the transfer bias that is applied after the front end of the recording paper comes into contact with the conveyance guide.

7. An image forming apparatus for electrophotographically forming an image on recording paper, comprising:

a photoreceptor drum including an outer circumferential surface on which a toner image is formed;

a transfer member which is provided in contact with the photoreceptor drum and transfers the toner image formed on the outer circumferential surface of the photoreceptor drum to the recording paper;

a transfer bias application circuit that applies a transfer bias to the transfer member;

a static elimination member which is disposed on a side that is more downstream in a conveyance direction of the recording paper than the transfer member and which eliminates static of the recording paper to which the toner image has been transferred;

a static elimination bias application circuit that applies a static elimination bias to the static elimination member;

a conveyance guide which is disposed on a side that is more downstream than the static elimination member and which guides the conveyance of the recording paper that has passed by the static elimination member; and a controller arranged and programmed to control the transfer bias application circuit based on constant voltage control during the period from when a front end region of the recording paper passes by the static elimination member until when a front end of the recording paper comes into contact with the conveyance guide, and to control the transfer bias application circuit based on constant current control after the front end of the recording paper comes into contact with the conveyance guide.

8. The image forming apparatus according to claim 6, further comprising a detector arranged to detect environmental conditions including at least one of either temperature or humidity, wherein the controller controls the transfer bias application circuit so that the transfer bias which is set based on the environmental conditions detected by the detector is applied to the transfer member after the front end of the recording paper comes into contact with the conveyance guide.

9. The image forming apparatus according to claim 6, wherein the controller controls the transfer bias application circuit so that the transfer bias which is set based on a value of current flowing in the transfer member when a test voltage is applied to the transfer member is applied to the transfer member after the front end of the recording paper comes into contact with the conveyance guide.

* * * * *